US005772320A

United States Patent [19]

Hayes

[11] Patent Number: 5,772,320

[45] Date of Patent: Jun. 30, 1998

[54] METHOD AND APARATUS FOR MIXING A METAL MATRIX COMPOSITE

[75] Inventor: Patrick James Hayes, South Wirral, Great Britain

[73] Assignee: EA Technology Limited, Chester, Great Britain

[21] Appl. No.: 676,192

[22] PCT Filed: Jan. 16, 1995

[86] PCT No.: PCT/GB95/00071

§ 371 Date: Sep. 4, 1996

§ 102(e) Date: Sep. 4, 1996

[87] PCT Pub. No.: WO95/19455

PCT Pub. Date: Jul. 20, 1995

[30] Foreign Application Priority Data

Feb. 17, 1994 [GB] United Kingdom ..... 9400757

[51] Int. Cl.[6] ..... B01F 15/02; C21C 7/00; C22C 1/00; C21B 15/00

[52] U.S. Cl. ..... 366/137; 366/127; 266/234; 266/233; 75/10.16; 420/590

[58] Field of Search ..... 366/137, 136, 366/132, 144, 145, 165.1, 127, 131, 273; 266/233, 234; 75/10.16; 420/590

[56] References Cited

U.S. PATENT DOCUMENTS

| | | | |
|---|---|---|---|
| 1,771,918 | 7/1930 | Fry | 266/918 |
| 2,655,550 | 10/1953 | Zvanut | 266/234 |
| 3,490,896 | 1/1970 | Steinke | 75/65 |
| 3,591,698 | 7/1971 | Howard et al. | 266/234 |
| 3,987,840 | 10/1976 | Birat | 164/466 |
| 4,007,921 | 2/1977 | Zingg . | |
| 4,572,673 | 2/1986 | Porter et al. | 366/127 |
| 4,589,637 | 5/1986 | Bamji et al. | 266/234 |
| 4,704,162 | 11/1987 | Bamji et al. | 75/10.14 |
| 5,322,417 | 6/1994 | Ottinger et al. | 417/50 |

FOREIGN PATENT DOCUMENTS

| | | |
|---|---|---|
| 54-032103 | 3/1979 | Japan . |
| 54-050403 | 4/1979 | Japan . |
| 1005643 | 1/1989 | Japan . |
| 1071566 | 3/1989 | Japan . |
| 629000 | 9/1978 | U.S.S.R. . |
| 1 211 084 | 11/1970 | United Kingdom . |
| 2 223 969 | 4/1990 | United Kingdom . |
| WO 87/06624 | 11/1987 | WIPO . |

*Primary Examiner*—Tony G. Soohoo
*Attorney, Agent, or Firm*—Westman, Champlin & Kelly, P.A.

[57] ABSTRACT

An method and apparatus is described for mixing solid particulates in a molten metal matrix to form a metal matrix composite product flow. The apparatus a refractory vessel to hold the metal matrix; a refractory conduit in communication with both the inlet and outlet of the refractory vessel so as to define a closed loop flow path. The inlet and outlet is spaced so as to encourage mixing within the vessel. A pump is provided to circulate the metal matrix to effect mixing. The apparatus and method further includes the metal matrix having a head with a vertical dimension in the excess of four times the cross sectional width of the conduit.

24 Claims, 3 Drawing Sheets

46
CONTROL
42
INERT GAS
40
10
44
VACUUM PUMP
4D
22B
22A
CONTROL
8D
11
22
D
18
HEAT
A
D
12
D
PUMP
16
14
15
20
CURRENT CONTROL
21

$10^\circ < \theta < 25^\circ$

METHOD AND APARATUS FOR MIXING A METAL MATRIX COMPOSITE

The present invention relates to a method and apparatus for mixing a metal matrix composite and in particular, but not exclusively, relates to a method and apparatus for mixing a metal matrix composite in either a liquid or semi-solid state. The method and apparatus may also find use in the formation of metal matrix composites which are produced by controlled cooling and stirring to stimulate precipitation of intermetallic compounds or other reinforcing phases which are then created in-situ.

A metal matrix composite as herein defined is a material which comprises a continuous metallic matrix phase throughout which there is deliberately dispersed during processing reinforcing particles, whiskers or fibres to achieve properties unobtainable by manipulation of the parent material alone. The reinforcing phases can be metallic, ceramic or intermetallic and are generally harder and stiffer than the continuous metallic phase. As a result the metal matrix composite typically exhibits better wear resistance and a higher specific stiffness than the unreinforced alloy.

In the past, metal matrix composites have been produced by mechanically mixing ceramic reinforcement materials such as particulate, whiskers or short fibres with a liquid metal contained in a suitable vessel. This mixing has been carried out using a variety of paddles which stir the liquid metal creating a vortex into which the reinforcement material is introduced. Once the reinforcement material has been introduced, it must then be prevented from segregating from the parent metal by settling or flotation, by means of further mixing. In the past this also has been achieved by means of mechanical mixing.

The mechanical mixing of metals, whether they be in the liquid state or in a semi-solid state at a temperature between the liquidus and solidus of the base alloy, gives rise to a number of disadvantages. Typically, stirring devices not only suffer from mechanical breakdown or errosion but also occupy regions of the melt surface which limits access to the melt for dispensing or other applications. In addition, mechanically stirred liquid metal systems are typically unable to eliminate stagnant zones or stable vortices within the mixing vessel so that in these regions centrifugal or gravitational forces tend to separate the reinforcement materials from the liquid alloy. The scaling up of laboratory mixing systems has also proved to be quite difficult for mechanical systems since larger systems typically require several mixers to operate simultaneously and so require constant supervision and/or maintenance if they are to achieve the desired effect. Furthermore, it goes without saying that mechanical impellers are susceptible to breakage during melt down of the solid charge.

The present invention is intended to go some way towards addressing the above-mentioned problems associated with the prior art.

According to a first aspect of the present invention there is provided an apparatus for mixing solid particulates in a molten metal matrix to form a metal matrix composite, the apparatus comprising a refractory vessel for containing the metal matrix in a molten state and defining an inlet and an outlet; refractory conduit means in communication with both the inlet and outlet so as to define with the vessel a closed loop flow path, the inlet and outlet being so spaced as to encourage mixing within the vessel; and pump means disposed within the flow path and operative to circulate the metal matrix and particulates around the closed loop path so as to effect a mixing thereof. This apparatus has the advantage of reducing the dependence on mechanical stirring devices as in the majority of cases the liquid, or semi-solid, metal constitutes the only moving component within the flow path. Furthermore, provided the metal is forced to circulate in such a way as to prevent settling under gravity and avoids the formation of stable vortices, it can be readily scaled to suit a desired holding capacity or composite throughput.

Advantageously, the pump means may comprise an electromagnetic pump. In this way the pump can be adapted to operate at high flow rates without the risk of suffering from blockage. In a preferred embodiment the electromagnetic pump may be of the linear motor type. Alternatively, a recirculating vacuum lift type pump might also be used.

Advantageously, means may be provided for controlling the velocity at which the metal matrix and particulates are circulated around the closed loop path. Preferably the pump means may be adapted such that the flow of metal matrix and particulates has a Reynolds number in excess of 700 calculated on the basis of a characteristic dimension of the vessel such as, for a cylindrical vessel, its radius.

Advantageously the flow path may include one or more acute or right angled bends so as to encourage the mixing of the metal matrix and particulates. Preferably, one or more members may be disposed within the flow path so as to create turbulence and facilitate the mixing of the metal matrix and particulates. Preferably the conduit means may include one or more additional refractory vessels. Preferably the inlet and outlet are spaced apart vertically or in some other way so as to avoid straight flow through. Preferably the flow path may be adapted such that the flow of metal matrix and particulates has a Reynolds number in excess of 700 calculated on the basis of a characteristic dimension of the vessel such as, for a cylindrical vessel, its radius.

Advantageously the refractory vessel may be of substantially circular cross-section and the longitudinal axis of the conduit means adjacent one or both of inlet and outlet is offset with respect to a radius of the vessel at an angle of between 10° and 25°. Preferably the refractory vessel is adapted to maintain a head of the metal matrix having a vertical dimension in excess of four times the cross sectional width of the conduit means. Preferably, the refractory vessel is adapted to operate under inert gas, reduced pressure or a vacuum.

Advantageously, means may be provided for adding the particulates to the metal matrix at locations within either the refractory vessel or the conduit means where the turbulent kinetic energy of the metal matrix is in excess of a predetermined threshold value and is sufficient to both wet and mix the particulates.

Advantageously, heating means may be provided within the flow path. Preferably this heating means may comprise an induction heating means.

Advantageously, means may be provided to control the temperature of the metal matrix, the control means being adapted to facilitate the precipitation of intermetallic compounds or other reinforcing phases within the matrix.

According to a second aspect of the present invention there is provided a method for mixing solid particulates in a molten metal matrix to form a metal matrix composite, the method comprising the steps of providing a refractory vessel in communication with refractory conduit means such that the vessel and conduit means define a closed loop flow path; providing a molten metal matrix and particulates within the closed loop path; and circulating the metal matrix and particulates around the closed loop path so as to effect a mixing thereof.

Advantageously, the method may comprise the additional step of controlling the velocity at which the metal matrix and particulates are circulated around the closed loop path. Preferably, where the refractory vessel and the conduit means define an inlet to the vessel, the velocity at which the metal matrix and particulates are circulated around the closed loop path may be controlled such that the flow of metal matrix and particulates has a Reynolds number in excess of 700 calculated on the basis of a characteristic dimension of the vessel such as, for a cylindrical vessel, its radius.

Advanageously, the method may comprise the additional step of controlling the quantity of metal matrix within the refractory vessel so as to maintain a head of the metal matrix having a vertical dimension in excess of four times the cross sectional width of the conduit means.

Advanageously, the method may comprise the additional step of adding particulates to the metal matrix at locations within either the refractory vessel or the conduit means where the turbulent kinetic energy is in excess of a predetermined threshold value and is sufficient to both wet and mix the particulates.

Advanageously, the method may comprise the additional step of controlling the temperature of the metal matrix. Preferably the temperature of the metal matrix may be controlled so as to facilitate the precipitation of intermetallic compounds or other reinforcing phases within the matrix.

A number of embodiments of the present invention will now be described by way of example with reference to the accompanying drawings, in which.

Figure 1:
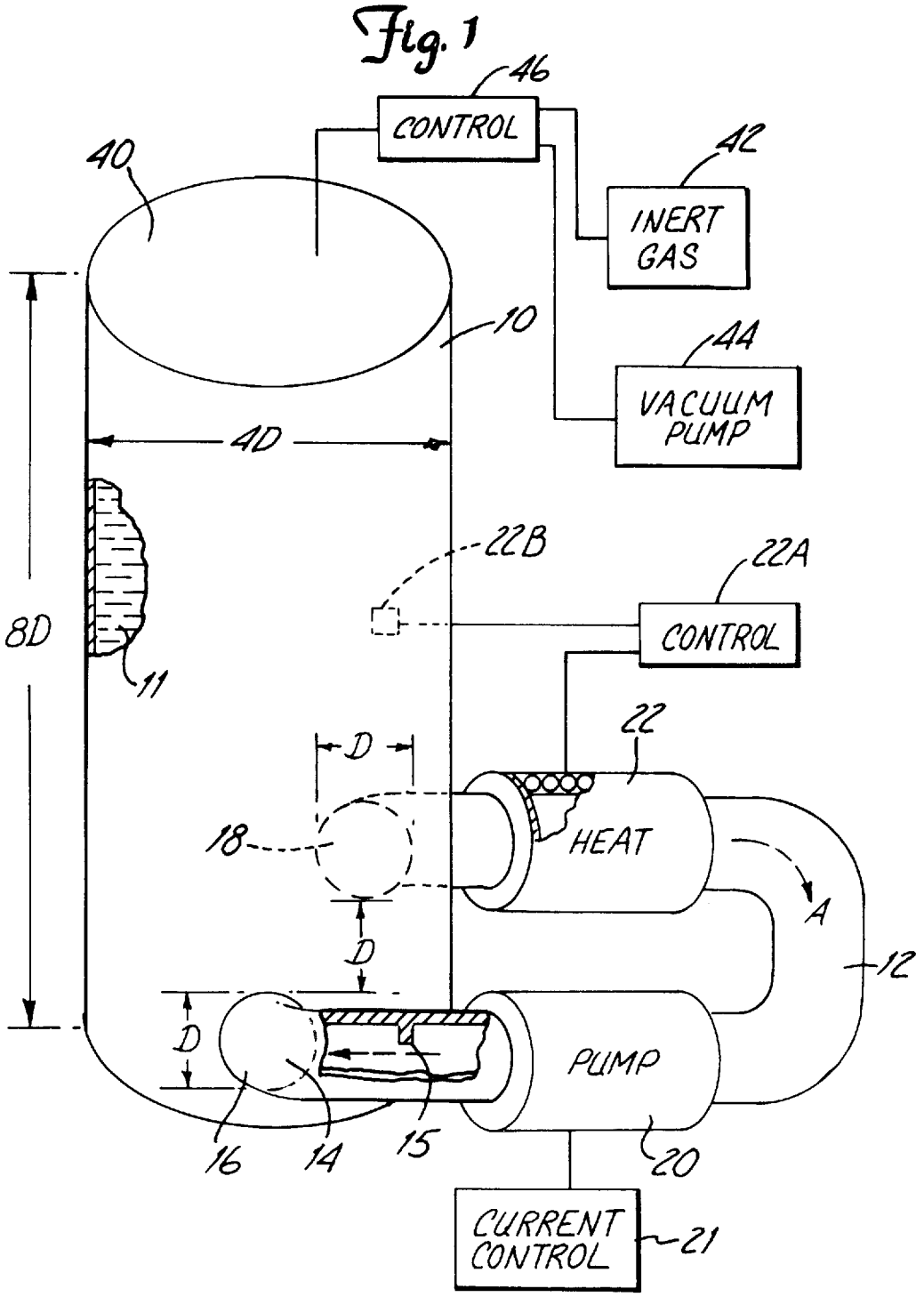
FIG. 1 is a schematic view of a mixing apparatus in accordance with a first embodiment of the present invention.

Referring to FIG. 1, there is shown an apparatus for mixing a metal matrix composite comprising a refractory vessel 10 and a refractory lined conduit 12. The conduit 12 is shown to be of substantially circular cross-section, having a diameter D, and is shaped so as to include at least one acute or right-angled bend 14. The conduit 12 communicates with the interior of the refractory vessel 10 at respective opposite ends and these ends define with the refractory vessel 10 an inlet 16 and an outlet 18. As a result, there is created within the apparatus a closed loop flow path for the passage of liquid or semi-solid metal matrix composite indicated at 11 in FIG. 1, where the vessel is broken away.

An electromagnetic pump 20 which has no moving parts is disposed within that part of the flow path defined by the conduit 12 and is operative to draw a quantity of the metal matrix composite to be mixed from the refractory vessel 10, and to pump that quantity through the conduit 12 in the direction of arrow A and then back into the refractory vessel so as to thereby effect a mixing of the composite. This mixing action is achieved by a combination of jet mixing (i.e. the pumping of a jet of the metal matrix composite from the inlet 16 into the refractory vessel 10) and turbulence created by forcing the liquid or semi-solid metal matrix composite to flow through a flow path containing one or more acute or right-angled bends 14. In this regard, it has been found that the degree of turbulence generated can be controlled by changing the rate of flow by controlling the electrical current supplied to the pump 20 by operating the current control 21 for the pump and that this turbulence is sufficient to prevent the settling of dense particulates or oxide build-up in either the refractory vessel 10 or the conduit 12, which would otherwise block the apparatus and require frequent removal. As a result, there is no need to pump the liquid or semi-solid metal matrix composite around shear plates such as that shown schematically at 15 in FIG. 1 or other obstructions placed within the flow path in order to achieve the necessary turbulent action, although clearly, one or more such members could be disposed within the flow path if so desired.

In addition to the pump 20, there may also be provided within the flow path, a heater 22 capable of maintaining the metal matrix composite at a temperature in excess of that at which pumping of the composite ceases to be practical. Clearly, the provision of such a heater 22 is not essential to the functioning of the apparatus when mixing metal matrix composites in the liquid state and under such circumstances simply comprises a preferred additional feature. However, in order to control the temperature during the mixing of semi-solid composites, the precipitation in-situ of a strengthening phase or the avoidance of reinforcement reactions with the liquid metal, it has been found preferable to provide a heater 22 which is controllable independently of the pump 20. One such heater 22 may comprise an induction coil wound around a length of the conduit 12 as shown in FIG. 1 although other forms of heater may also be provided. For example, the refractory vessel 10 may itself comprise a modified coreless induction furnace or else the mixing apparatus may be equipped with a radiant heating system. The heater 22 can be controlled with a controller 22A that can be a standard set point controller, with a temperature sensor 22B mounted to sense the temperature of the material in the vessel, or in the conduit and provide a feedback signal to the controller so that the desired temperature can be maintained.

Turning now to a consideration of the mixing apparatus in more detail, the refractory vessel 10 may, in general, be of any desired configuration. It has been found, however, that vessels which are substantially cylindrical or rectangular in shape may be incorporated within a closed loop flow path in such a way that the critical regions near the base of the vessel are stirred with sufficient turbulence to promote a random mixing action. This mixing action prevents the settlement of the reinforcing material while the stirring brings the same material to the melt surface without causing disruption to the surface skin.

Figure 2:
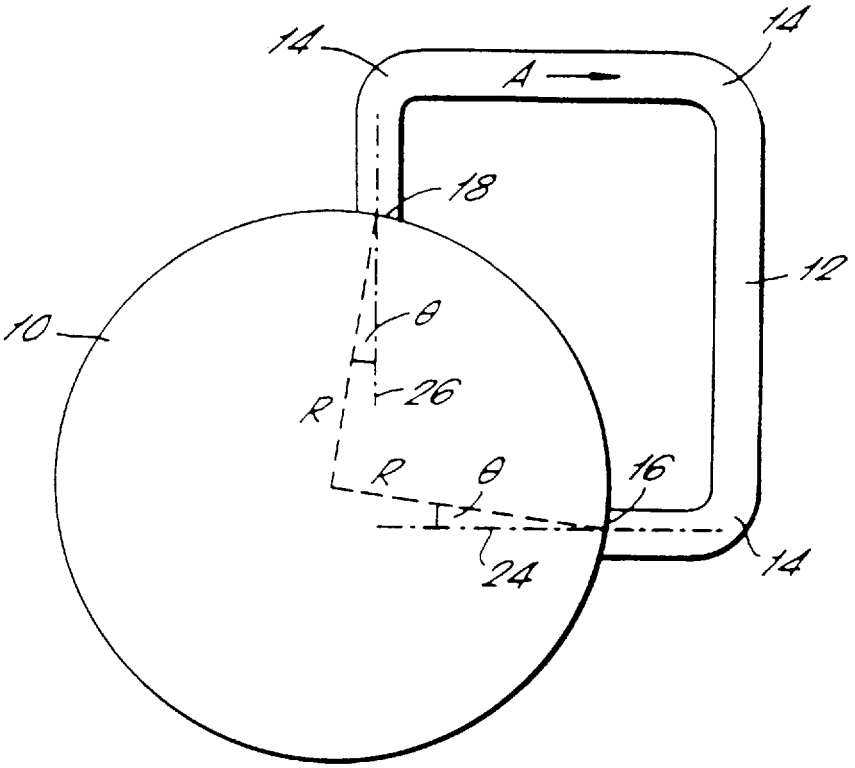
FIG. 2 is a schematic plan view of the mixing apparatus of FIG. 1.

To facilitate this mixing action still further, it has been found beneficial in connection with cylindrical vessels to so adapt the conduit 12 that the longitudinal axes of both the inlet 16 and outlet 18 are offset with respect to a radius R of the vessel 10 by an angle of between 10° and 25°. Such an arrangement enhances the contribution of jet mixing to the combined mixing action and it is this arrangement that is illustrated in FIG. 2 in which the longitudinal axes of the inlet 16 and outlet 18 are indicated by reference numerals 24 and 26 respectively.

Another means of facilitating the mixing action is to adapt both the refractory vessel 10 and the conduit 12 so that the inlet 16 and outlet 18 occupy different horizontal and vertical planes thereby avoiding straight throughflow. This is the arrangement illustrated in FIG. 1 in which a lower edge of the inlet 16 is shown to be substantially flush with the base of the refractory vessel 10 and to be in communication with one part of the interior where the outlet 18 is disposed at a somewhat greater distance from the base and is in communication with another part of the interior. In this particular embodiment the planes occupied by the inlet 16 and outlet 18 are separated by a distance approximately equal to that of the diameter of the conduit 12 while the refractory vessel itself is cylindrical and has a diameter equal to approximately four times that of the conduit.

Figure 3:
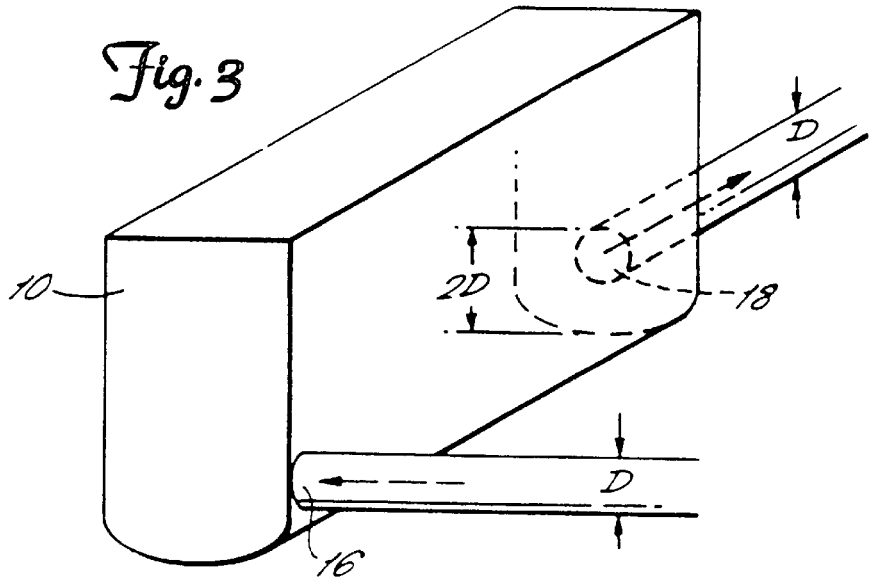
FIG. 3 is a schematic view of a mixing apparatus in accordance with a second embodiment of the present invention.

In still another arrangement, this time illustrated in FIG. 3, the refractory vessel 10 may be of generally rectangular cross-section with the inlet 16 and outlet 18 formed in a different one of the longer and shorter sides respectively. It has been found that using this configuration of refractory vessel 10, provided the corners are suitably radiused to comply with good refractory design and to minimize local stagnant or recirculation zones, it is possible to maintain the homogeneity of ready-made suspensions whilst avoiding the establishment of stable vortices which might otherwise cause local settling, air entrapment or centrifugal separation. Nevertheless, the fact that particles with a gravitational settling velocity greater than approximately $1\times10^{-3}ms^{-1}$ may separate unless the liquid metal is forced to circulate in such a way that the Reynolds number based on the radius of the conduit exceeds 15,000, does have implications for the relative dimensions of the refractory vessel 10. For this reason in one preferred embodiment, the shorter side of the refractory vessel has a dimension similar to, but slightly greater than, the diameter of the conduit 12 while the longer side has a dimension approximately six times larger. Based on these relative dimensions, it has been found that the capacity of the refractory vessel 10 can be scaled to meet any desired manufacturing requirement, always provided of course, that the pump 20 is capable of maintaining the pressure head necessary to realize the required Reynolds number. A three-phase linear motor pumping coil is best suited to this purpose.

Figure 4:
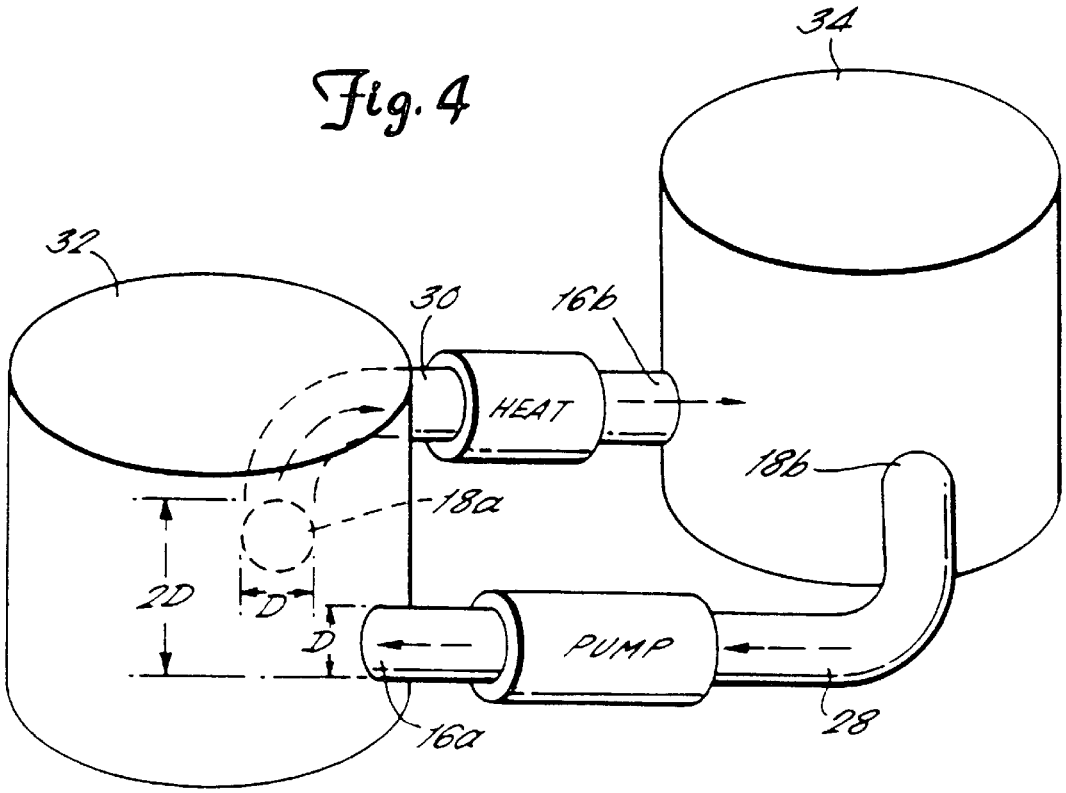
FIG. 4 is a schematic view of a mixing apparatus in accordance with a third embodiment of the present invention.

In yet another arrangement, the conduit 12 may be formed in two pipe sections 28 and 30 and incorporate a second or further refractory vessel. An example of one such twin vessel design is illustrated in FIG. 4 in which the inlet 16*a* to a first of the vessels 32 is shown as being substantially flush with the base of that vessel while its outlet 18*a* is disposed at a height from the base approximately equal to the diameter of the conduit 12. The second vessel 34 is then a mirror image of the first with the outlet 18*b* substantially flush with the base and the inlet 16*a* disposed at a height again approximately equal to the diameter of the conduit 12. Since the conduit is itself formed in two pipe sections 28 and 30, each may incorporate a respective one of the pump 20 and heater 22. With this arrangement it is possible to create stable vortices to take material below the melt surface in the second vessel 34 and mix it with the liquid metal using the turbulence generated in the first vessel 32. For example, it has been found that fine particulate silicon carbide having a diameter of less than 30 microns may be kept in suspension using the arrangement illustrated in FIG. 4 by ensuring that the Reynolds number calculated on the basis of the vessel radius is maintained above 700 for the first vessel 32 and above 1,000 for the second vessel 34.

The fact that non-similar vessels may be incorporated at either end of the pump 20 allows the retrofitting of the mixing apparatus to traditional furnaces such as induction, radiantly heated, reverberatory or tower melting units. Furthermore, since the pumping action provides good temperature distribution throughout the melting and holding vessels, it is possible in this way to provide an integrated melting and holding unit. Having said that, the refractory geometry of the interconnected vessels must be such that there is a minimum metal velocity over the bases of both vessels so that the settling of dense refractory reinforcing particles is avoided. This can be achieved using the mixing induced by jet flow at the inlet 16 at Reynolds numbers calculated on the basis of a the radius of the conduit exceeding 15,000 and, if necessary for non-cylindrical vessels, by the incorporation at their base of one or more baffles equivalent to the rectangular geometry illustrated in FIG. 3.

It has been found that the separation of fine gas bubbles from the particulate suspension can cause problems during processing. For this reason a liquid metal head is preferably provided above the inlet 16 and outlet 18 while additional steps are taken to ensure that all the joints between the or each vessel and the conduit are leak-tight. Clearly, this needs to be achieved without compromising the flow turbulence as defined by the Reynolds number at the base of the or each of the vessels or within the conduit. Accordingly, the vessels illustrated in FIGS. 1 to 4 are preferably filled to a height greater than four times the diameter of the conduit 12 so as to avoid the entrainment of air. Clearly, during operation, significant changes in head height may occur if the liquid or semi-solid metal is pumped from one vessel to another, depending on the flow resistance offered by the conduit 12. Nevertheless, the metal head in the supply vessel should be maintained sufficiently high so as to prevent aspiration. Alternatively, the mixing apparatus may be adapted so as to operate under inert gas, reduced pressure or a vacuum by incorporating within the top of the vessel a vacuum-tight flange and the appropriate "O" ring seals and by the provision of a vacuum lid 40 connected to a suitable gas supply 42, vacuum pump 44 and control system 46.

The mixing apparatus so far described is capable of maintaining reinforcement particles in suspension in a metal matrix composite. However, when adding reinforcement material to the melt it is advantageous to do so in such a way that the material is rapidly immersed and then carried quickly to the regions of high shear rate and maximum turbulent kinetic energy. These regions are located close to the acute or right-angled bends 14 in the conduit 12, adjacent the outlet 18 and directly opposite the inlet 16 where the inertia of the liquid metal flow causes it to impact with the refractory lining of the vessel 10. Any one of a variety of methods may be used to introduce additional reinforcement material such as, for example, one or more refractory feeder pipes which may serve to direct the material concerned into the stirred melt in the locality of a feeder vortex defined by the downward swirl generated within a mixing apparatus having a similar geometry to the second vessel shown in FIG. 4. The material is then quickly brought into the high shear regions at the inlet to the first vessel where it undergoes jet mixing.

By contrast, the in-situ precipitation of reinforcement materials can be induced by carefully reducing the temperature of the melt so as to precipitate intermetallic compounds or by the addition of a separate molten alloy into a stirred base alloy.

I claim:

1. An apparatus for mixing solid particulates in a molten metal matrix to form a metal matrix composite, the apparatus comprising a refractory vessel for containing the metal matrix in a molten state and defining an inlet and an outlet; refractory conduit means in communication with both the said inlet and said outlet so as to define with said vessel a closed loop flow path, said inlet and outlet being so spaced as to encourage mixing within said vessel; and pump means disposed within said flow path and operative to circulate the metal matrix and particulates around said closed loop path so as to effect a mixing thereof, said vessel containing a filling of the metal matrix having a head with a vertical dimension in excess of four times the cross-sectional width of said conduit means.

2. An apparatus in accordance with claim 1, wherein said pump means is free of moving parts within said closed loop flow path.

3. An apparatus in accordance with claim 1, wherein said pump means comprises an electromagnetic pump.

4. An apparatus in accordance with claim 1, wherein means are provided for controlling the velocity at which the metal matrix and particulates are circulated around said closed loop path.

5. An apparatus in accordance with claim 1, wherein said pump means is operated to provide a flow velocity of metal matrix and particulates such that the flow has a Reynolds number in excess of 700 calculated on the basis of a transverse dimension of said vessel.

6. An apparatus in accordance with claim 1, wherein said flow path includes at least one bend formed at an angle sufficient to cause turbulence to encourage the mixing of the metal matrix and particulates.

7. An apparatus in accordance with claim 1, wherein at least one member is disposed to project into said flow path, so as to create turbulence and facilitate the mixing of the metal matrix and particulates.

8. An apparatus in accordance with claim 1, wherein said conduit means includes at least one additional refractory vessel.

9. An apparatus in accordance with claim 1, wherein the said inlet and outlet are spaced apart vertically.

10. An apparatus in accordance with claim 1, wherein velocity in said flow path is controlled such that the flow of metal matrix and particulates has a Reynolds number in excess of 700 calculated on the basis of a transverse dimension of said vessel.

11. An apparatus in accordance with claim 1, wherein the refractory vessel is of substantially circular cross-section and the longitudinal axis of said conduit means adjacent one or both of said inlet and outlet is offset with respect to a radius of said vessel at an angle of between 10° and 25°.

12. An apparatus in accordance with claim 1, wherein the refractory vessel is selectively subjected to one of the group consisting of an inert gas, and a pressure less than atmospheric.

13. An apparatus in accordance with claim 1, wherein means are provided for adding the particulates to the metal matrix at locations within either the refractory vessel or said conduit means where the turbulent kinetic energy of the metal matrix is in excess of a predetermined threshold value.

14. An apparatus in accordance with claim 1, wherein heating means are provided within said flow path.

15. An apparatus in accordance with claim 13, wherein said heating means comprises an induction heating means.

16. An apparatus in accordance with claim 1, wherein means are provided to control the temperature of the metal matrix, said control means being adapted to facilitate the precipitation of intermetallic compounds or other reinforcing phases within said matrix.

17. A metal matrix composite when mixed using the apparatus of claim 1.

18. A method for mixing solid particulates in a molten metal matrix to form a metal matrix composite, the method comprising the steps of providing a refractory vessel in communication with refractory conduit means such that said vessel and said conduit means define a closed loop flow path; providing a molten metal matrix and particulates within said closed loop path; providing a quantity of the metal matrix in the vessel having a head of the metal matrix with a vertical dimension in excess of four times the cross-sectional width of the conduit; and circulating the metal matrix and particulates around said closed loop path so as to effect a mixing thereof.

19. A method in accordance with claim 18 and comprising the additional step of controlling the velocity at which the metal matrix and particulates are circulated around said closed loop path.

20. A method in accordance with claim 19, wherein the refractory vessel and said conduit means define an inlet to said vessel and the velocity at which the metal matrix and particulates are circulated around said closed loop path is controlled such that the flow of metal matrix and particulates has a Reynolds number in excess of 700 calculated on the basis of a characteristic dimension ofsaid vessel.

21. A method in accordance with claim 18, and comprising the additional step of adding particulates to the metal matrix at locations within either the refractory vessel or said conduit means where the turbulent kinetic energy of the metal matrix is in excess of a predetermined threshold value.

22. A method in accordance with claim 18, and comprising the additional step of controlling the temperature of said metal matrix.

23. A method in accordance with claim 22, wherein the temperature of said metal matrix is controlled so as to facilitate the precipitation of intermetallic compounds or other reinforcing phases within said matrix.

24. A metal matrix composite when mixed using the method of claim 18.

* * * * *